US005312101A

United States Patent [19]

McDaniel

[11] Patent Number: 5,312,101

[45] Date of Patent: May 17, 1994

[54] TABLE TENNIS PADDLE

[75] Inventor: Don W. McDaniel, P.O. Box 988, Lemon Grove, Calif. 91946

[73] Assignee: Donald W. McDaniel, Lemon Grove, Calif.

[21] Appl. No.: 890,853

[22] Filed: Jun. 1, 1992

[51] Int. Cl.[5] ..... A63B 59/04

[52] U.S. Cl. ..... 273/76

[58] Field of Search ..... 273/67 R, 67 DA, 67 DC, 273/735, 76

[56] References Cited

U.S. PATENT DOCUMENTS

| | | | |
|---|---|---|---|
| D. 164,883 | 10/1951 | Schmid | 273/76 X |
| 1,930,281 | 10/1933 | Ogden | 273/67 R |
| 3,674,268 | 7/1972 | Shellman | 273/76 |
| 4,148,483 | 4/1979 | Sweet et al. | 273/67 R |
| 4,227,692 | 10/1980 | Castelli | 273/67 R |
| 4,307,882 | 12/1981 | Hay et al. | 273/67 R X |
| 4,757,996 | 7/1988 | McNutt et al. | 273/67 R |

FOREIGN PATENT DOCUMENTS

| | | | |
|---|---|---|---|
| 3239076 | 4/1984 | Fed. Rep. of Germany | 273/76 |
| 3820743 | 12/1989 | Fed. Rep. of Germany | 273/76 |
| 2373303 | 8/1978 | France | 273/76 |
| 2611144 | 8/1988 | France | 273/76 |
| 0043525 | 4/1977 | Japan | 273/76 |
| 9119545 | 12/1991 | World Int. Prop. O. | 273/76 |

*Primary Examiner*—William Stoll

[57] ABSTRACT

A preferred embodiment of a novel paddle for use in racquet sports, and particularly table tennis, is disclosed. The paddle features a handle which is designed to comfortably conform to the player's grip while both enhancing total backhand play and allowing for ease of rotation to forehand play at any time on either side of the body. Thus, a paddle which eliminates ever being caught out of position.

6 Claims, 1 Drawing Sheet

TABLE TENNIS PADDLE

BACKGROUND OF THE INVENTION

1. Field of the Invention

This invention relates to structures known as bats, racquets or paddles (hereinafter, "paddles") for use in ball games. It specifically relates to paddles for use in table tennis or ping pong games.

2. History of the Prior Art In most racquet sports, particularly table tennis and ping pong (hereinafter collectively referred to as "table tennis"), the paddle consists of a flat paddle surface ("blade") of varying shape attached to, and in the same plane of, a handle. As a result of this single plane configurations any effort to strike a ball so it moves in any direction other than in a perpendicular plane to the player's body requires the player to twist or bend his or her wrist in proportion to the angle of ball movement which is desired.

In addition, the player's movements are constrained by the need to either rotate the paddle up to 180 degrees or more around the player's body, or to change the hands holding the paddle, to allow a backhand shot to be made.

To explain, as opposed to the forehand side of the body, the backhand side is considered to be the one opposite the hand holding the paddle when the player is at rest. Similarly, the backhand side of the paddle is (as opposed to the forehand) that side which faces in the opposite direction of the palm of the hand which holds the paddle. To change play from forehand to backhand, therefore, the paddle must be fully rotated around the player's body from its forehand to its backhand side. Not only is this required rotation somewhat awkward to achieve, it also causes the player to lose much of the time available to address the ball to positioning the paddle for play.

Further, the traditional table tennis paddle consists of substantially cylindrical handle immovably attached to the paddle blade. Except for the possible presence on the handle of cushioning means (such as compressible foam), the handle does not conform structurally to the player's hand. As a result, it can only be gripped by allowing the hand to encompass the handle, leaving the paddle in a substantially perpendicular position with respect to the player's wrist. As a result, the most comfortable paddle position is not the one best suited for play, thus encouraging fatigue of the player's wrist and hand.

What is needed, therefore, is a paddle for racquet sports, and particularly for table tennis, which allows the player to comfortably make both forehand, backhand and angled strokes with minimal adjustment of the paddle position.

SUMMARY OF THE INVENTION

In essence, the paddles of this invention consist of two principal structural components which are either formed separately and joined, or molded as a single piece. These components are the blade and handle.

In the embodiment described, the attachment of the handle to the blade must include each of the following five points:

(1) The center line plane of the handle and the plane of the blade are two separate but intersecting planes between 0° and 45°.

(2) The handle contained within its plane is rotated outward and downward from the upper attachment to the blade at an angle between 0° and 90°, thus allowing the paddle surface to be an extention of the arm rather than perpendicular to the wrist as is normal with conventional paddles.

(3) The plane of attachment of the handle to the blade lies between the lines of intersection of the planes containing the two parallel sides of the handle with the blade.

(4) The blade extends only forward from the terminal end attachment line of the handle with the blade. This feature allows the same surface area on both sides of the blade for striking the ball.

(5) A portion of the handle is tilted above or below its midline horizontal plane at an angle greater than 0° up to or at 20°, now referred to as the yaw of the handle.

The yaw of the handle provides for a greater rotation of the paddle, for striking the ball, without having to rotate the wrist.

In addition, the handles are structured to conform to the player's hand and a comfortable wrist position, and further configured to provide for a more secure grip than provided by conventional paddles.

DESCRIPTION OF THE PREFERRED EMBODIMENT

Figure 1:
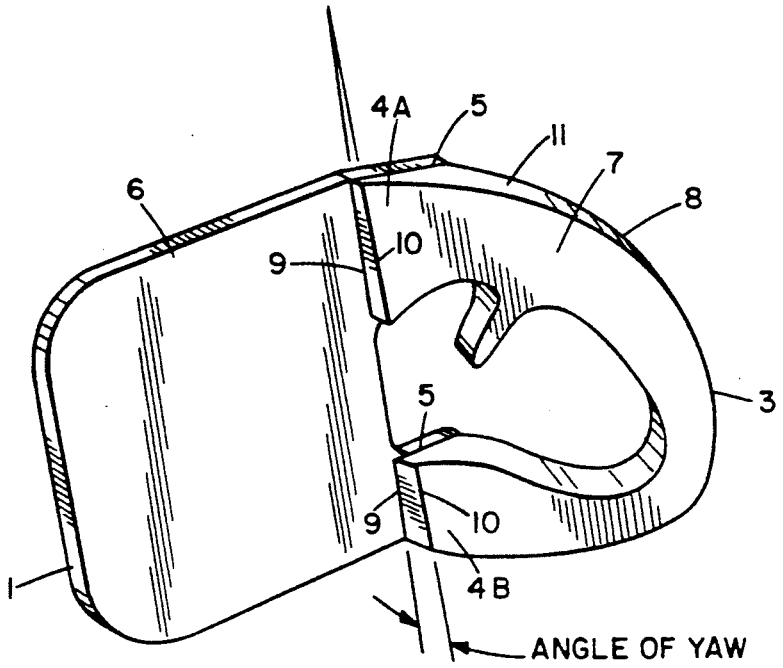
FIG. 1 is a perspective view of a preferred configuration of the paddle.

FIG. 1 depicts one embodiment of the invention paddle in perspective view. In this embodiment, blade 1 and handle 3 are separate components. Handle 3 is in substantially a "U" shaped configuration wherein each of the terminal ends of legs 4A and 4B of the "U" are attached by attachment means to the forehand face 6 of blade I along on edge thereof. This embodiment provides a most secure grip for a right handed player. A left handed paddle would be a mirror image of FIG. 1. The center line plane containing handle 3 and the forehand face 6 of blade 1 are two separate, but intersecting planes between 0° and 45°, best shown in FIG. 2. The handle 3 contained within its plane is rotated outward and downward from the attachment of upper leg 4A to blade 1 at an angle between 0° and 90°.

The plane of attachment 5 of the handle 3 to the blade 6 lies between the lines of intersection of the planes containing the two parallel- sides 7 and 8 of the handle. The handle may be either open or closed. FIG. 1 demonstrates a closed handle where the grip of-the handle lies between an upper and lower attachment to the blade. An open handle would not have lower leg 4B and would, therefore, only attach at the terminal end of leg 4A. The closed handle provides the most secure attachment of the handle and blade to prevent any undesired movement between the two parts.

The blade 6 extends only forward from the terminal end attachment line 9. This feature allows the same surface area on both sides of the blade for striking the ball. The blade may be any number of configurations, but is substantially configured within a 6 inch width by 6 inch height.

Figure 3:
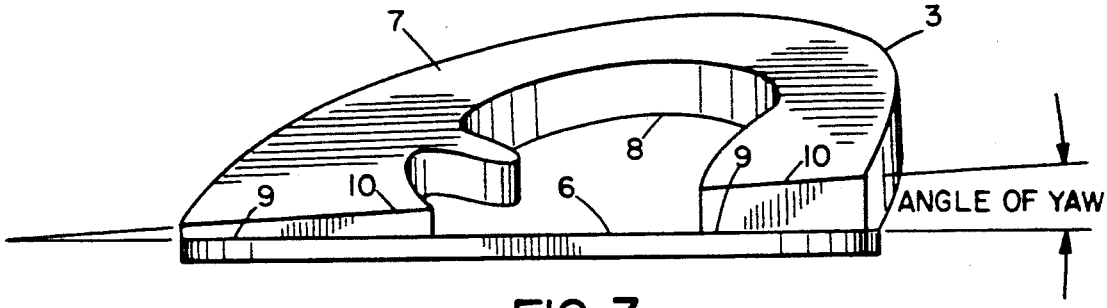
FIG. 3 is a front plan view of the paddle of FIG. 1 showing the yaw of the handle.

A portion of the handle 3 is tilted above or below its midline horizontal plane at an angle greater than 0° up to or at 20°, now referred to as the yaw of the handle. FIG. 1 and FIG. 3 demonstrate the yaw of the handle. The Terminal end line 10 of Upper side wall 7 of handle 3 which is parallel with the center line plane of the handle, sets at an angle between 0° and 20° with the terminal end attachment line 9 between the handle and blade. The yaw of the handle provides for a greater rotation of the paddle, for striking the ball, without having to rotate the wrist.

Figure 2:
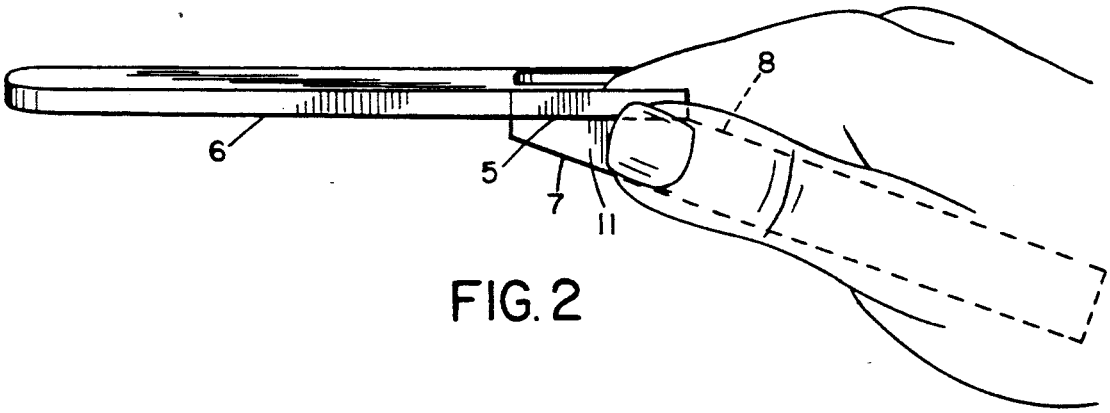
FIG. 2 is a sectional view taken on line 2—2 of FIG. 1, showing the gripping alignment.

FIG. 2 is a sectional view taken on line 2—2 of FIG. 1 showing the gripping alignment. The thumb is positioned along the outer edge 11 of handle 3 to allow for greater rotational capability of the paddle.

The angles of attachment of the handle to the blade allow the player to strike the ball with either side of the blade without rotation of his or her grip on the handle regardless of whether the ball approaches the player on the forehand or backhand side, although it is expected that the backhand surface of the blade will be used predominantly in play. It should be noted, that the angles of attachment allow for the most comfortable and effective play as they allow the player to rotate the blade with minimal motion to use its backhand surface on the forehand side of the body and, conversely, the forehand surface on the backhand side of the body.

The advantage of using the backhand surface of the blade predominantly to strike the ball in play is that the response time needed to set up the play by rotating the paddle from the backhand to the forehand side is eliminated. For that reason, the angled handle will enhance backhand play, but will allow forehand strokes to be utilized to best advantage in strokes requiring the ball to be stroked forcefully downward onto the table.

FIGS. 1 and 2 show the most preferred handle configuration for a very secure grip while allowing the player to have a semi-relaxed hand grip during play. The handle has two curvatures along the gripping surface to conform, respectively, to the index and, possibly, the middle finger of the player's hand (with the thumb resting along the top outer edge II,) while the second curvature accommodates the remaining fingers of the player's hand. The extension between two of the fingers stabilizes the handle and prevents it from sliding out of position while being held onto lightly.

It will be appreciated by those skilled in the art that modifications can be made to the embodiment of the invention disclosed herein without departing from the spirit or concept of the invention.

I claim:

1. A paddle for use in racquet sports, particularly table tennis, comprising:

a substantially flat blade;

a handle which lies in a distinctly different, but intersecting plane between 0° and 45° to the plane of the blade;

the handle contained within this plane extends outward and downward from the upper attachment to the blade at an angle between 0° and 90°;

the handle is tilted above or below its midline horizontal plane at an angle greater than 0° up to or at 20°;

the plane of attachment of the handle to the blade lies between the lines of intersection of the planes containing the two parallel sides of the handle with the blade;

the playing surface of the blade extends only forward from the terminal end attachments of the handle, thus allowing for the same surface area on both sides of the blade;

the handle having two curvatures along the inner gripping surface separated by an extension of said surface.

2. The paddle according to claim 1 wherein the handle and blade are plastic molded in one piece.

3. The paddle according to claim 1 wherein either of the handle and blade is formed of structural foam or wood.

4. The paddle according to claim 1 where the lower leg of the handle does not exist, thus having only one attachment point of the handle to the blade.

5. The paddle according to claim 4 wherein the attachment means are adjustable.

6. The paddle according to claim 1 or 4 where there is only one curvature along the inner gripping surface of the handle to accommodate the four fingers.

* * * * *